US005941296A

United States Patent [19]

Kanehira

[11] Patent Number: 5,941,296

[45] Date of Patent: Aug. 24, 1999

[54] METHOD FOR CONTROLLING THE FORMATION OF A SAND MOLD

[75] Inventor: Yuso Kanehira, Takaoka, Japan

[73] Assignee: Metal Engineering Kabushiki Kaisha, Takaoka, Japan

[21] Appl. No.: 08/585,750

[22] Filed: Jan. 16, 1996

Related U.S. Application Data

[63] Continuation of application No. 08/216,991, Mar. 24, 1994, abandoned.

[51] Int. Cl.[6] ..... B22C 15/02

[52] U.S. Cl. ..... 164/37; 164/40

[58] Field of Search ..... 164/37, 40, 456

[56] References Cited

U.S. PATENT DOCUMENTS

| | | | |
|---|---|---|---|
| 3,241,199 | 3/1966 | Rabinovich | 164/40 X |
| 3,828,840 | 8/1974 | Lund et al. | 164/207 |
| 4,063,586 | 12/1977 | Keller | 164/207 |
| 4,598,756 | 7/1986 | Fuchigami et al. | 164/207 |

FOREIGN PATENT DOCUMENTS

| | | | |
|---|---|---|---|
| 1482416 | 5/1967 | France | 164/207 |
| 2712489 | 9/1978 | Germany | 164/207 |
| 56-30056 | 3/1981 | Japan | 164/207 |
| 57-142744 | 9/1982 | Japan | 164/172 |
| 5-76990 | 3/1993 | Japan | 164/37 |
| 5-269546 | 10/1993 | Japan | 164/37 |
| 179436 | 5/1966 | U.S.S.R. | 164/207 |
| 457531 | 6/1973 | U.S.S.R. | 164/207 |
| 1613242 | 12/1990 | U.S.S.R. | 164/40 |
| 2050892 | 1/1981 | United Kingdom | 164/207 |

*Primary Examiner*—J. Reed Batten, Jr.
*Attorney, Agent, or Firm*—Hazel & Thomas, P.C.

[57] ABSTRACT

A space defined by inside surfaces of a main molding flask and lower auxiliary flask and the upper surface of a pattern plate where the upper surface of the pattern plate is retained at a predetermined level along the inside surfaces of the main molding flask and lower auxiliary flask is filled with an amount of molding sand. The molding sand is then squeezed in the space with upper and lower press heads in at least one of upward and downward directions to form at least one of first and second halves of a sand mold such that a lower surface of the first or second half of the sand mold is formed at a desired level along the inside surfaces of the main molding flask and lower auxiliary flask irrespective of edges of the main molding and lower auxiliary flasks. The desired level is determined by the level of the upper surface of the pattern plate at the time when the squeezing step has finished.

3 Claims, 5 Drawing Sheets

METHOD FOR CONTROLLING THE FORMATION OF A SAND MOLD

This application is a Continuation of application Ser. No. 08/216,991, filed Mar. 24, 1994 and now abandoned.

BACKGROUND OF THE INVENTION

1. Field of the Invention

The present invention relates to a method and apparatus for making a sand mold, more particularly to a molding method and apparatus, wherein the joint surface of the sand mold can easily be formed in such a way as to be projected or recessed from the edge of a molding flask in accordance with the shape of a casting product by the use of molding flasks in hand.

2. Description of the Prior Art

The parting plane of a pattern for making a sand mold is determined in consideration of the shape of a casting product. In general, each half of the pattern split along the parting plane is mounted on the surface of a pattern plate with the parting plane thereof, and a molding flask is placed on the pattern plate. An amount of molding sand is filled over the pattern in the molding flask, rammed by any proper means and then stripped off the pattern to form a mold cavity left behind the pattern. Thereafter, two halves of the sand mold or cope and drag are assembled to complete the sand mold. Thus, the parting plane of the pattern or the joint surface of the sand mold coincides with the lower edge of the molding flask.

For such a shape of the casting as shown in FIG. 6, however, an upper half section of the mold cavity in the cope and a lower half section of the mold cavity in the drag are unbalanced in their height, resulting in the difference of sand thickness from the respective section of the cavity to the edge of the respective flask to cause various problems when molten metal is cast into the sand mold. First, a small thickness of the molding sand causes an irregular packing density of sand to be easily deformed in portions of the sand mold with a low packing density to lead to dimensional inaccuracy or defects in the produced casting. Secondly, temperature remarkably rises in portions of the sand mold with a small thickness when molten metal is poured thereinto, so that the quality of the molding sand in those portions deteriorates to cause problems in reclamation of used molding sand.

According to the prior art to solve such problems as described above, there have been proposed several methods such as the use of tripled flasks or filling different amounts of sand into the upper half and lower half of the sand mold. These methods, however, respectively have disadvantages such as the need of complicated and large-size apparatus or difficulties in uniforming the packing density of the filled sand. Another method, as shown in FIG. 7, wherein the parting plane of the pattern and the corresponding edges of the flasks are positioned in a stepped manner and connected with a sloping surface with each other to form a joint surface of the mold, is capable of uniforming the thickness of sand on the pattern in the upper half and lower half of the mold, but the pattern is complicated in construction and heavy in weight and the productivity of castings may decrease.

Furthermore, since a demand for the casting products of a small lot recently tends to increase and their life cycle has been shortened, it has become very difficult to always establish molding conditions adequate to each of these products with the use of molding flasks in hand, causing a renewal of the sand molding line as a whole in extreme cases.

SUMMARY OF THE INVENTION

It is, therefore, a primary object of the present invention to provide a simple method and apparatus for making a sand mold, wherein the joint surface of a sand mold is freely designed irrespective of the edge of molding flasks to make an upper half and a lower half of the sand mold in order to adapt molding flasks in hand to a wide range of shape of the casting products without troubles due to the irregular thickness of the molding sand.

Another object of the present invention is to provide a molding method and apparatus, wherein a sand mold is made in such a manner that the lower surface of filled and squeezed molding sand is outward projected or inward recessed from the edge of the molding flask by a predetermined length, respectively.

A further object of the present invention is to provide a molding method and apparatus, wherein it is not necessary to form a sloping surface between the edge of the molding flask and the parting plane of the pattern to make a joint surface of the sand mold.

According to the present invention, there is provided a method for making a sand mold, which comprises the steps of placing a main molding flask on the upper edge of a lower auxiliary flask; fixing a pattern plate to the upper surface of a lower press head, the lower press head being assembled relatively movably upward and downward along the inside surface of the main molding flask and lower auxiliary flask; filling an amount of molding sand in a cavity formed by the inside surface of the main molding flask and lower auxiliary flask and the upper surface of the pattern plate in a condition where the upper surface of the pattern plate is maintained at a predetermined level along the inside surface of the main molding flask and lower auxiliary flask; and squeezing the filled molding sand at least in one of upward and downward directions; wherein the lower surface of the filled molding sand is formed at a desired level along the inside surface of the main molding flask and lower auxiliary flask, the level being determined by the level of the upper surface of the pattern plate at the time when the squeezing is finished.

In a preferred embodiment of the present invention. One half of the sand mold is made with the level of the upper surface of the pattern plate projected from the lower edge of the molding flask in a predetermined length when the squeezing is finished, while the other half of the sand mold is made with the level of the upper surface of the pattern plate recessed from the lower edge of the molding flask in the predetermined length when the squeezing is finished, and then the two halves of the sand mold are assembled into a set of the sand mold.

BRIEF DESCRIPTION OF THE DRAWINGS

Other objects, features and advantages of the present invention will more readily be appreciated from the following detailed description of a preferred embodiment thereof when taken together with the accompanying drawings, in which.

DESCRIPTION OF THE PREFERRED EMBODIMENT

Figure 1:
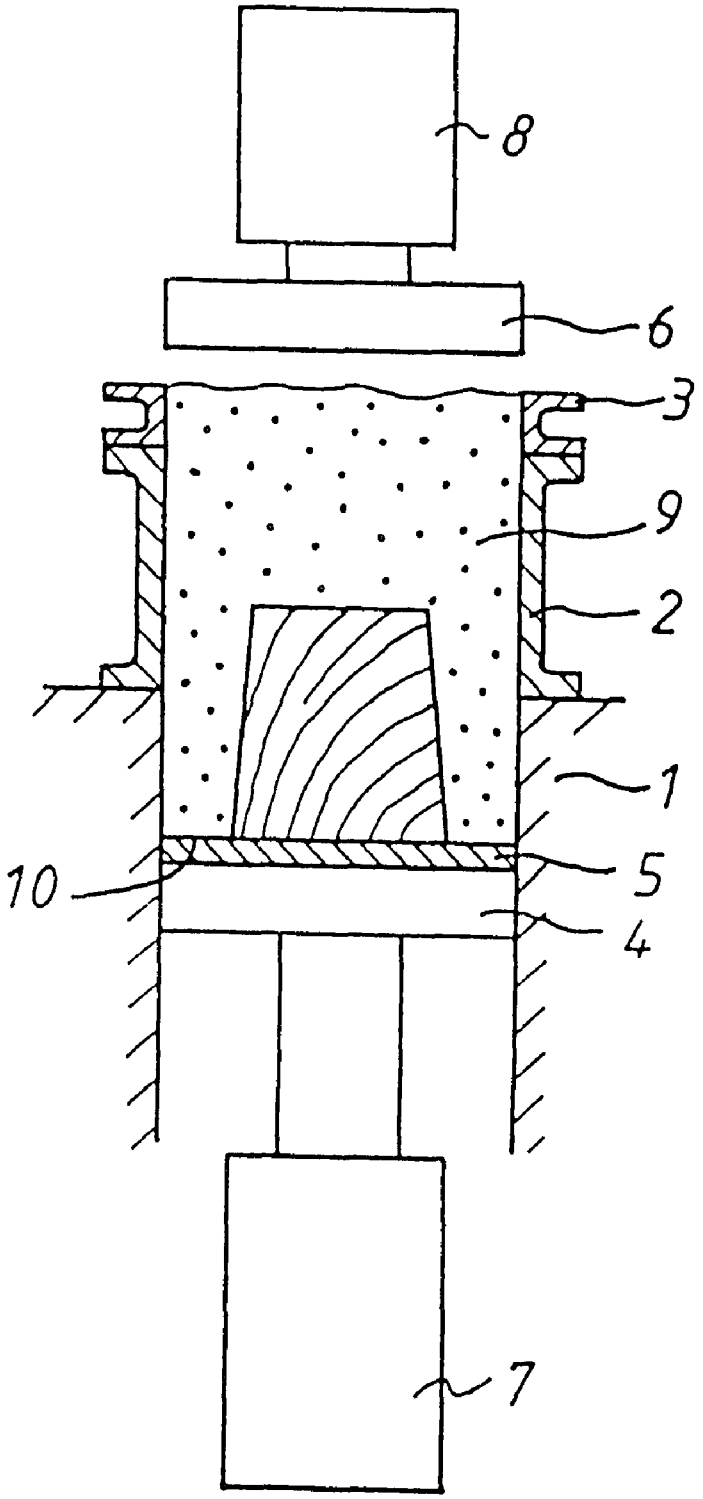
FIG. 1 is a schematic longitudinal sectional view of an apparatus in accordance with the present invention in the case of making one half of a sand mold with the level of the upper surface of a pattern plate projected from the lower edge of a molding flask in a predetermined length when squeezing is finished.

Referring now to the drawings, where like reference numerals represent the same or corresponding parts throughout the figures, FIG. 1 illustrates a molding apparatus, which includes a lower auxiliary flask 1, a main molding flask 2 placed on the upper edge of lower auxiliary flask 1, an upper auxiliary flask 3 placed on the upper edge of main molding flask 2, a lower press head 4 arranged to be moved upward and downward along the inside surface of main molding flask 2 and lower auxiliary flask 1, a pattern plate 5 fixed to the upper surface of lower press head 4, and an upper press head 6 vertically movably positioned over the upper auxiliary flask 3.

Into a space defined by the inside surface of main molding flask 2, lower auxiliary flask 1 and upper auxiliary flask 3 and the upper surface of pattern plate 5, an adequate amount of molding sand 9 is fed to fill the space. The upper auxiliary flask 3 serves to act as an allowance for downward compression of molding sand 9. The lower auxiliary flask 1, which is fixedly mounted on a base structure (not shown), serves to act as an allowance for upward compression of molding sand 9 and enables the lower surface 10 of a sand mold to be formed at a level projected out of the lower edge of main molding flask 2.

The lower press head 4 is actuated by a lower squeeze cylinder 7 to be upward and downward moved, stopped at a desired level, retained at the desired level, and lifted for upward compression of molding sand 9.

The upper press head 6 is actuated by an upper squeeze cylinder 8 to be upward and downward moved, stopped at a desired level, retained at the desired level, and lowered for downward compression of molding sand 9.

The pressure and sequence of squeeze, the levels of stop and fixation, and amounts of lifting and lowering of lower and upper press heads 4, 6 may be automatically controlled by an automatic controller (not shown).

Hereinafter, a molding method will be explained in detail to make a sand mold by the use of the molding apparatus in accordance with the present invention. Illustrated in FIGS. 2A, to 2D is a sequence of a molding process for making one half of the sand mold with the level 10 of the lower surface of filled molding sand 9 or the level of the upper surface of pattern plate 5 projected downward from the lower edge of main molding flask 2 into the lower auxiliary flask 1 in a predetermined length.

FIG. 1 shows a state where the surface of pattern plate 5 is stopped at a predetermined level in the lower auxiliary flask 1 by lifting the lower press head 4, and where the molding sand 9 has been filled in the space described above to finish a sand filling step. At this step, the level of the surface of pattern plate 5 is determined in consideration of a desired projection length of the lower surface 10 of filled sand 9 and an allowance for upward compression of molding sand 9 caused by a second squeeze described later.

Figures 2A, 2B, 2C, 2D:
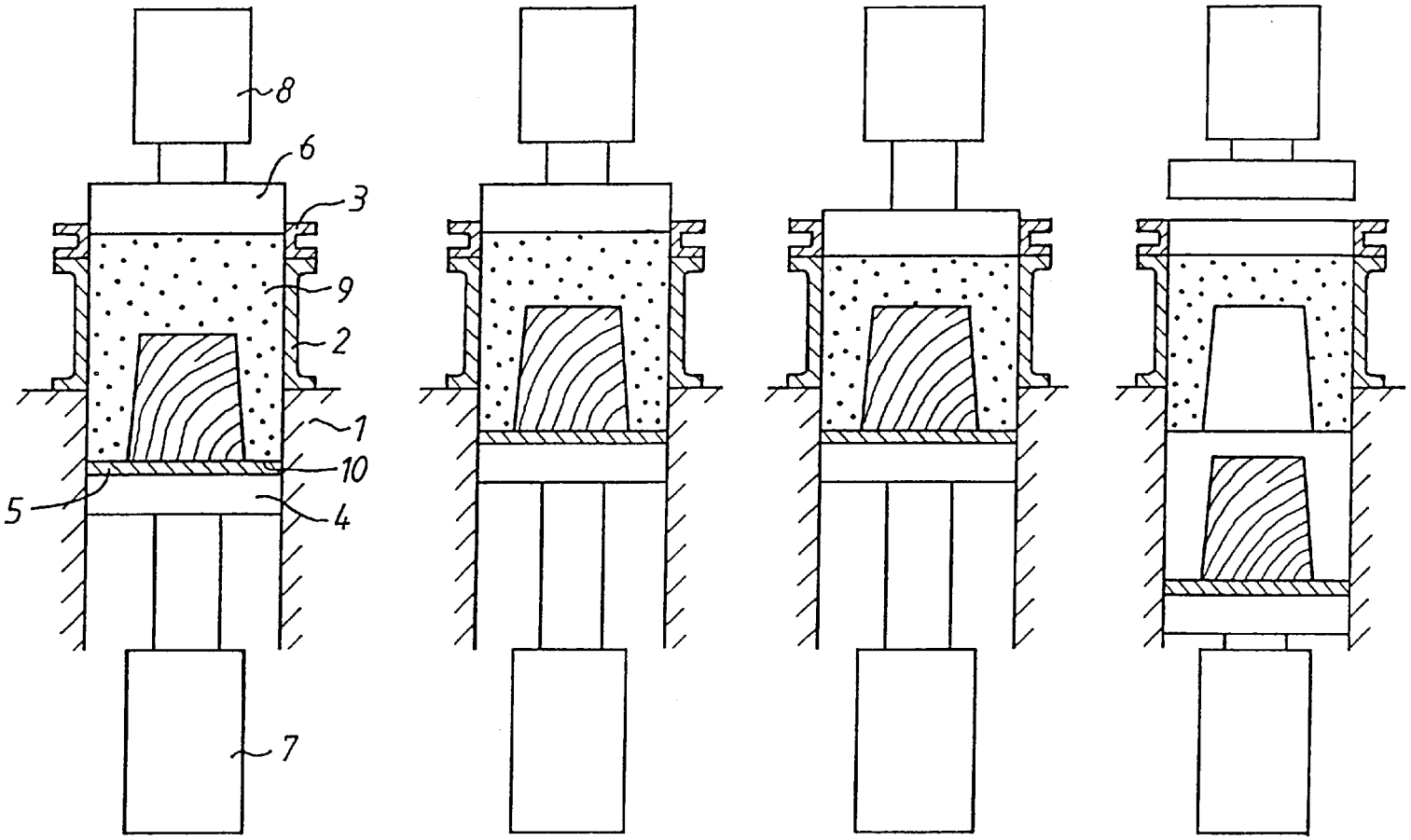
FIGS. 2A, 2B, 2C and 2D are schematic longitudinal sectional views illustrating a molding process for making the one half of the sand mold shown in FIG. 1.
Figure 3:
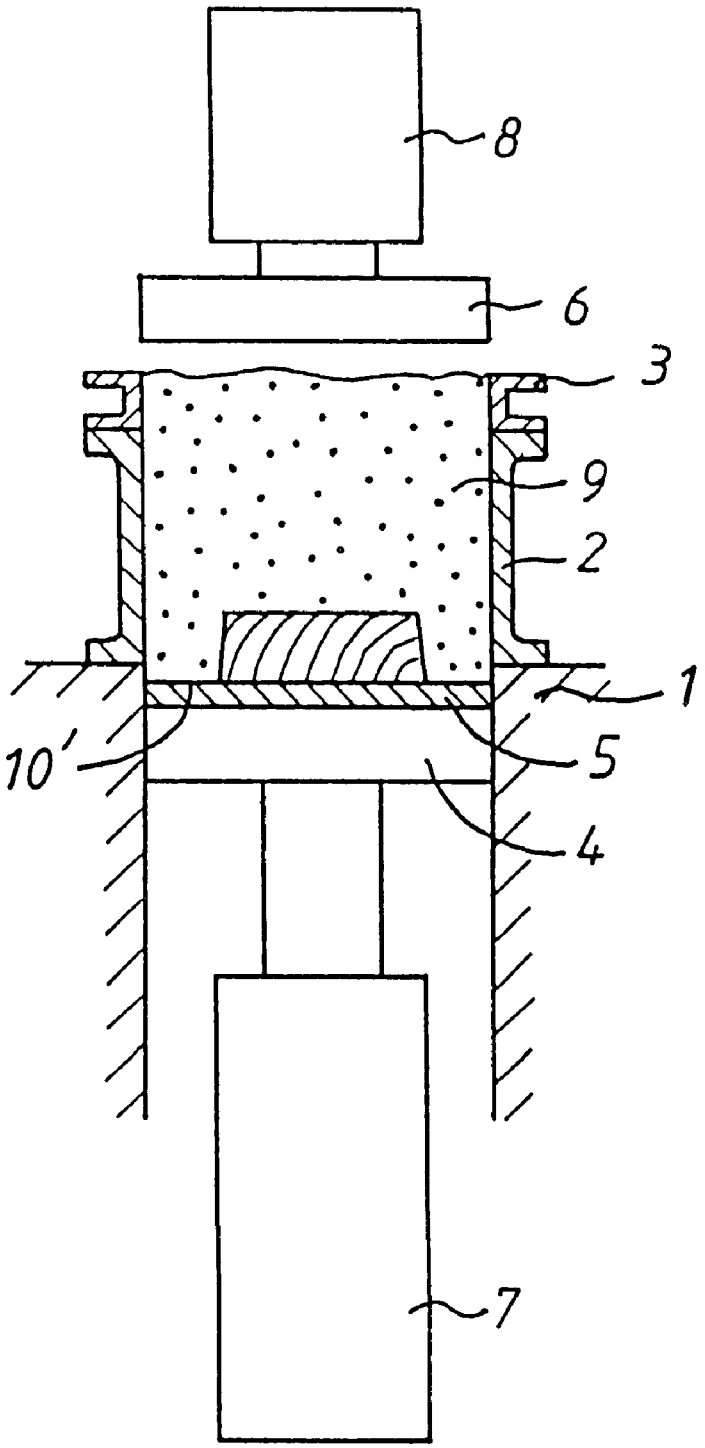
FIG. 3 is a schematic longitudinal sectional view in the case of making the other half of the sand mold with the level of the upper surface of the pattern plate recessed from the lower edge of the molding flask in the predetermined length when squeezing is finished.

FIG. 2A shows a state where, with the level of lower press head 4 retained at the level as shown in FIG. 1, the molding sand 9 is downward squeezed by lowering the upper press head 6 against the upper surface of molding sand 9 to finish a first squeeze.

FIG. 2B shows a state where, with the level of upper press head 6 retained at the level as shown in FIG. 2A, the molding sand 9 is upward squeezed by lifting the lower press head 4 against the lower surface 10 of molding sand 9 to project the upper surface of pattern plate 5 in a predetermined length from the lower edge of main flask 2 into the lower auxiliary flask 2 so as to finish a second squeeze.

FIG. 2C shows a state where, with the level of lower press head 4 retained at the level as shown in FIG. 2B, the molding sand 9 is downward squeezed by lowering the upper press head 6 against the upper surface of molding sand 9 until the upper surface of molding sand 9 coincides with the upper edge of main flask 2 to finish a third squeeze.

FIG. 2D shows a state where the upper press head 6 is lifted and the lower press head 4 is lowered to finish stripping of molding sand 9 off the pattern plate 5.

Figure 4D:
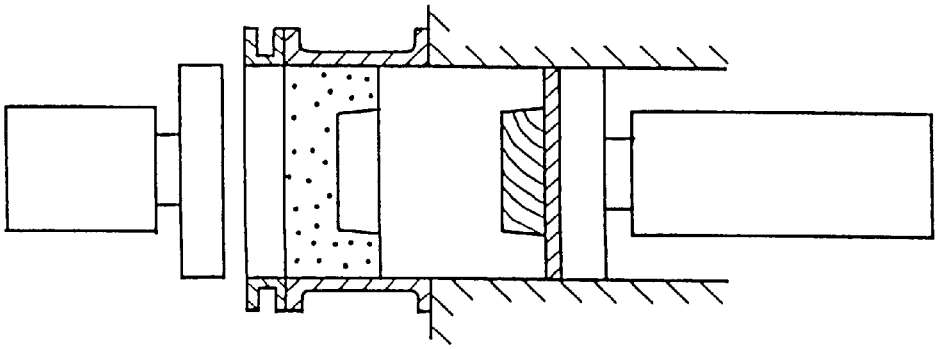
FIGS. 4A, 4B, 4C and 4D are schematic longitudinal sectional views illustrating a molding process for making the other half of the sand mold shown in FIG. 3.
Figure 4C:
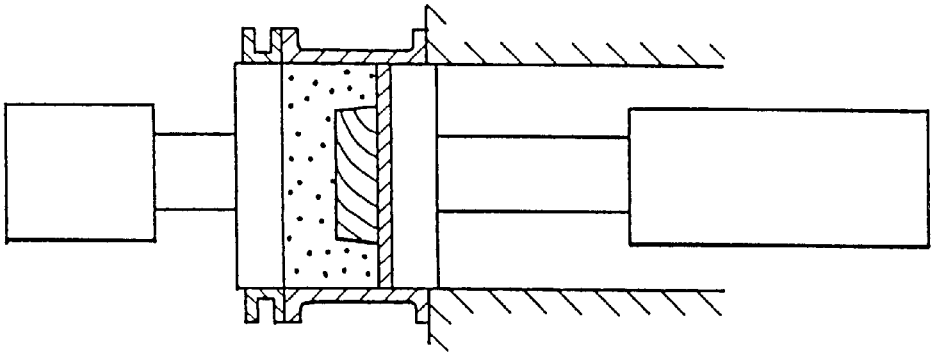
Figure 4B:
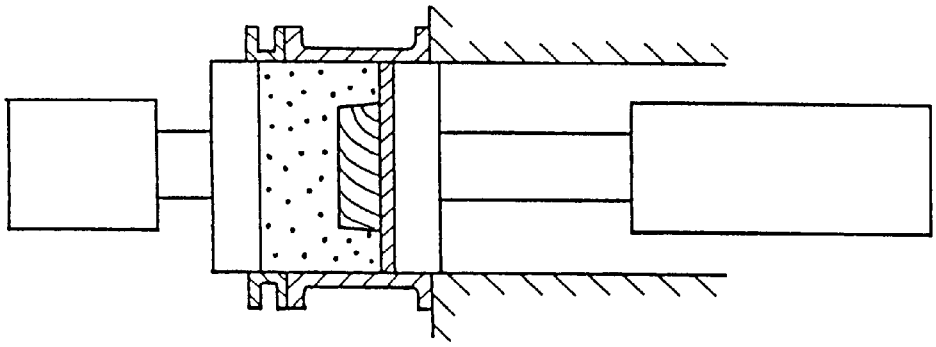
Figure 4A:
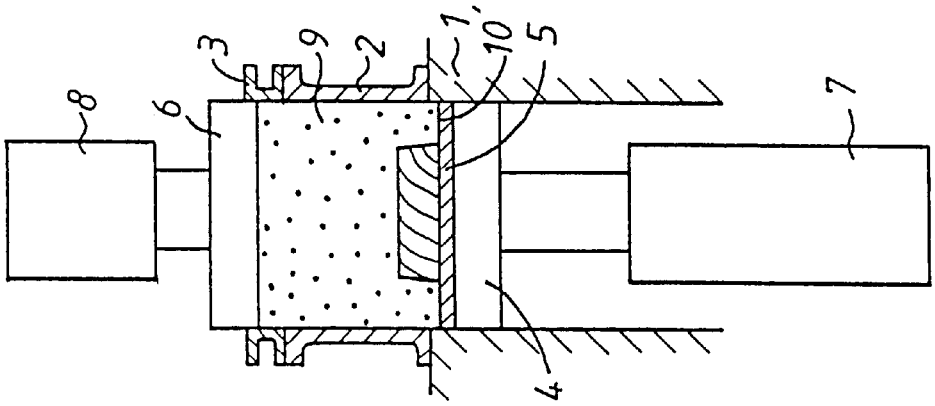

Illustrated in FIGS. 4A to 4D is a sequence of a molding process for making another half of the sand mold with the level 10' of the lower surface of molding sand 9 or the level of the upper surface of pattern plate 5 recessed upward from the lower edge of main molding flask 2 into the the flask 2 in a predetermined length. In this case, as shown in FIGS. 4B and 4C, the upper surface of pattern plate 5 is lifted to and retained at the level recessed upward from the lower edge of main molding flask 2 into the the flask 2 in the predetermined length. The other sequence is substantially the same as explained as to FIGS. 1 and 2A through 2D.

Figure 5:
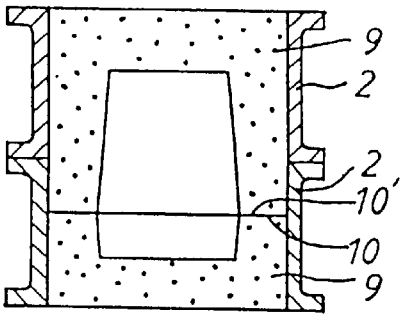
FIG. 5 is a schematic longitudinal sectional view illustrating an assembled sand mold two halves of which are made in accordance with the processes shown in FIGS. 1, 2A to 2D, 3 and 4A to 4D, respectively.
Figure 6:
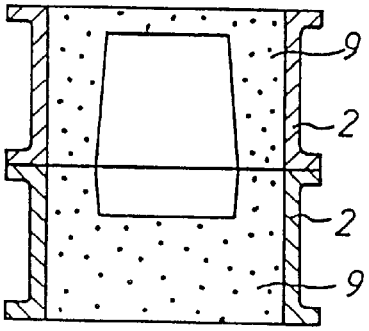
Fig. 6 Prior Art
FIG. 6 is a schematic longitudinal sectional view illustrating an assembled sand mold made in accordance with a method of the prior art.
Figure 7:
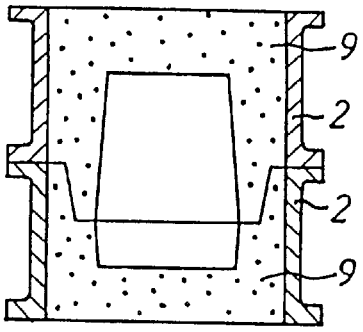
Fig. 7 Prior Art
FIG. 7 is a schematic longitudinal sectional view illustrating an assembled sand mold made in accordance with another method of the prior art.

In accordance with the method and apparatus as described above, one half of the sand mold may be made with the surface of the pattern plate outward projected in the predetermined length from the edge of a flask, while the other half of the sand mold may be made with the surface of the pattern plate inward recessed in the predetermined length from the edge of another flask. Thereafter, the two halves of the sand mold each are taken out of the molding apparatus to be assembled as shown in FIG. 5. Although in FIG. 5 the upper half of the mold has a joint surface 10 projected out of the upper flask and the lower half has a joint surface 10' recessed into the lower flask, the upper half of the mold may have a joint surface recessed into the upper flask and the lower half a joint surface projected out of the lower flask in a reverse manner.

In a preferred embodiment, as also shown in FIG. 5, the pattern plate may be mounted thereon with one half section of a pattern split along the parting plane thereof in the case where one half of the sand mold is made, while the pattern plate may be mounted thereon with the other half section of the pattern in the case where the other half of the sand mold is made thereby to complete a set of the sand mold for a casting product.

In modifications, the upper auxiliary flask 3 may be eliminated, or either one of lower and upper press heads 4, 6 may be fixed to a base structure. In the case, where the upper press head 6 is vertically movable while the lower press head 4 fixed, the level of the upper surface of pattern plate 5 may be adjusted with respect to auxiliary flask 1 and main flask 2 by the vertical movement of lower auxiliary flask 1 by the use of a cylinder and the like, so as to be moved, stopped and retained in position and to squeeze and strip the molding sand off the pattern plate. In the case, where the lower press head 4 is vertically movable while the upper press head 6 fixed, the level of the upper surface of pattern plate 5 may be adjusted in the same manner as described above by the vertical movement of lower auxiliary flask 1 separately from the lower press head 4. The direction, sequence and number of times of squeeze are not limited to those of the above embodiment. The cylinder may be actuated hydraulically, pneumatically or electrically to move and retain the respective press heads or flask in position.

As is easily understood from the above description, according to the present invention, the joint surface of a sand mold is freely designed irrespective of the edge of molding flasks to adapt the molding flasks in hand to a wide range of shape of casting products. The joint surface of the sand mold may be formed to be outward projected or inward recessed from the edge of the molding flask. As a result, the thickness of the molding sand on the pattern in one half of the sand mold can substantially coincide with that in the other half of the sand mold to avoid the dimensional inaccuracy and defects of the casting product and irregularity in properties of the recovered sand due to irregular thickness of the molding sand. In comparison with the prior art, wherein a sloping surface is formed between the edge of the molding flask and the parting plane of the pattern to make the joint surface of the sand mold, the pattern is lighter in its weight and less expensive in manufacturing cost and the productivity of the products increases. According to the present invention, thus, molding methods and apparatus are not only simplified but also the thickness of the molding sand on the pattern can be uniformed in the upper and lower flasks for various shapes of the casting products to prevent defects in the products and to uniform the properties of the recovered sand.

It is to be further understood by those skilled in the art that the foregoing description is a preferred embodiment of the present invention and that various changes and modifications may be made in the invention without departing from the spirit and scope thereof.

What is claimed is:

1. A method for making a sand mold, comprising the steps of:

placing a main molding flask on the upper edge of a lower auxiliary flask;

fixing a pattern plate to the upper surface of a lower press head, said lower press head being assembled relatively movably upward and downward along inside surfaces of said main molding flask and lower auxiliary flask;

filling a space defined by the inside surfaces of said main molding flask and lower auxiliary flask and the upper surface of said pattern plate in a condition, where the upper surface of said pattern plate is retained at a predetermined level along the inside surfaces of said main molding flask and lower auxiliary flask, with an amount of molding sand;

squeezing said molding sand in said space in at least one of upward and downward directions;

forming the lower surface of a desired sand mold from said molding sand at a desired level along the inside surfaces of said main molding flask and lower auxiliary flask irrespective of edges of said main molding and lower auxiliary flasks, said level being determined by the level of the upper surface of said pattern plate at the time when said squeezing is finished, wherein the sand mold is defined having a first half and a second half;

forming said first half of the sand mold with the level of the upper surface of said pattern plate being projected from the lower edge of said main molding flask by a predetermined length at the time when said squeezing step is finished;

forming said second half of the sand mold with the level of the upper surface of said pattern plate being recessed from the lower edge of said main molding flask by the predetermined length at the time when said squeezing step is finished; and assembling said first and second halves of the sand mold into the sand mold.

2. The method as claimed in claim 1, wherein said step of fixing said pattern plate includes mounting said pattern plate with the first half section of a pattern split along a parting plane thereof corresponding to said first half of the sand mold, and mounting said pattern plate with the second half section of the pattern corresponding to said second half of the sand mold.

3. A method of controlling an operation of a molding apparatus having a lower auxiliary flask, a main molding flask placed on the upper edge of said lower auxiliary flask, a lower press head arranged to be moved upward and downward along inside surfaces of said main molding flask and lower auxiliary flask, a pattern plate fixed to the upper surface of said lower press head, and an upper press head arranged above said main molding flask to be moved downward and upward along the inside surface of said main molding flask, the method comprising the steps of:

filling a space defined by inside surfaces of said main molding flask and lower auxiliary flask and the upper surface of said pattern plate in a condition where the upper surface of said pattern plate is retained at a predetermined level along the inside surfaces of said main molding flask and lower auxiliary flask with an amount of molding sand; and squeezing the molding sand in said space with said upper and lower press heads in at least one of upward and downward directions to form at least one of first and second halves of a sand mold such that the lower surface of the first or second half of the sand mold is formed at a desired level along the inside surfaces of said main molding flask and lower auxiliary flask irrespective of edges of said main molding and lower auxiliary flasks, said desired level being determined by the level of the upper surface of said pattern plate at the time when said squeezing step has finished, wherein said step of squeezing the molding sand in said space includes forming the first half of said sand mold by adjusting the level of the upper surface of said pattern plate to be projected downward from a lower edge of said main molding flask at a predetermined length along the inside surface of said lower auxiliary flask at the time when said squeezing step has finished, and forming the second half of said sand mold by adjusting the level of the upper surface of said pattern plate to be recessed upward from the lower edge of said main molding flask at the predetermined length along the inside surface of said main molding flask at the time when said squeezing step has finished.

* * * * *